United States Patent [19]

Grace et al.

[11] 4,005,870

[45] Feb. 1, 1977

[54] GOLF PUTTING TRAINING METHOD

[76] Inventors: Henry A. Grace, 3412 Pennsylvania St., Hyattsville, Md. 20783; Robert G. Conrad, 1600 Dillon Road, Maple Glen, Pa. 19002

[22] Filed: Oct. 7, 1975

[21] Appl. No.: 620,373

Related U.S. Application Data

[60] Division of Ser. No. 411,028, Oct. 30, 1973, Pat. No. 3,917,280, which is a continuation-in-part of Ser. No. 313,352, Dec. 8, 1972, abandoned.

[52] U.S. Cl. ..... 273/183 R; 273/32 H; 35/29 A; 273/185 R

[51] Int. Cl.[2] ..... A63B 69/36

[58] Field of Search ..... 273/77 R, 192, 87.2, 273/87.4, 87 R, 87 C, 87 B, 32 H, 183 R, 183 E, 184 A, 185 R; 35/29 A

[56] References Cited

UNITED STATES PATENTS 1,618,638 2/1927 Coles ..... 273/77 R 3,332,688 7/1967 Gevertz ..... 273/192 X

*Primary Examiner*—George J. Marlo
*Attorney, Agent, or Firm*—Andrew L. Ney

[57] ABSTRACT

A method and machine for teaching the reading of golf putting greens wherein the distance to the cup is calculated and a corresponding force is selected and perfectly applied to a golf ball by the putting machine to verify the calculation. The steps may be repeated until the projected golf ball enters the cup. To compensate for the lie of the putting surface, an optical system using mirrors is mounted to a putter drive assembly to project the golf ball at an angle with respect to the line of sight to the cup. The putter drive assembly includes a plurality of pairs of holes in which two pins are placed to define the plane at which the golfer should strike the ball in order to duplicate the stroke of the putting machine.

4 Claims, 6 Drawing Figures

FIG. 3
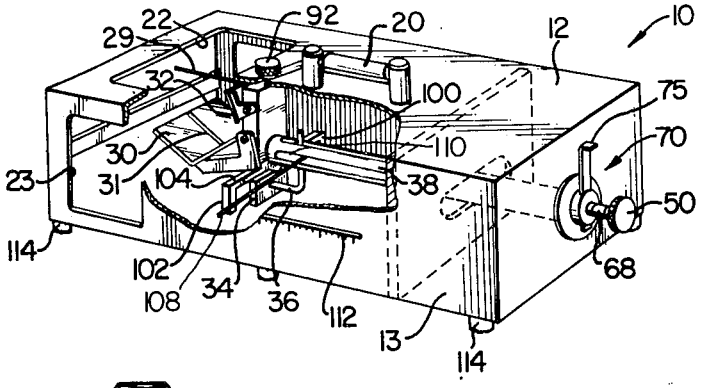
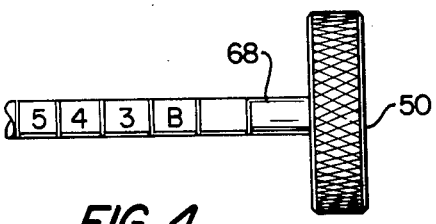
FIG. 4
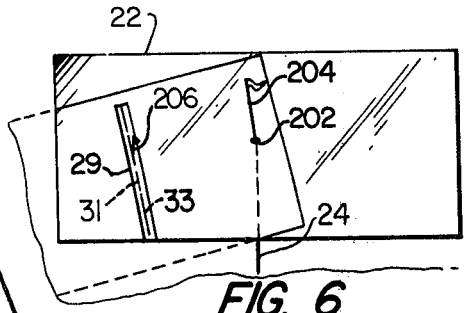
FIG. 6
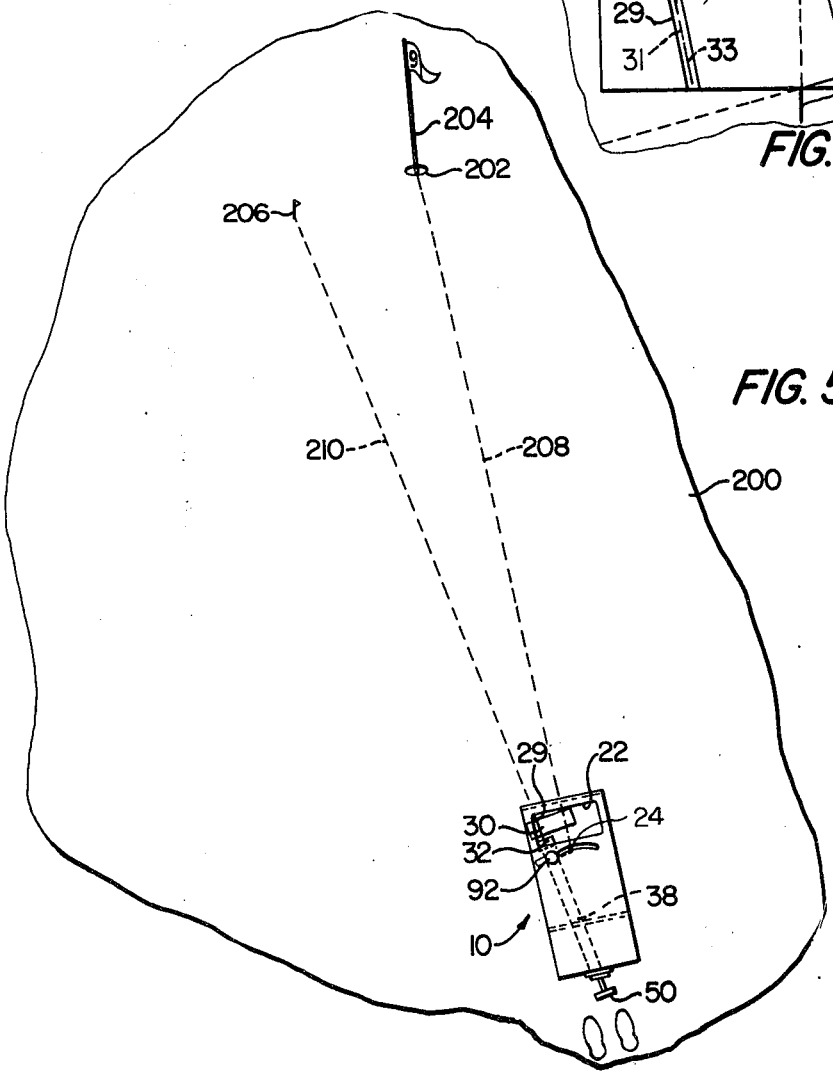
FIG. 5

GOLF PUTTING TRAINING METHOD

BACKGROUND OF THE INVENTION

This application is a division of Ser. No. 411,028 filed Oct. 30, 1973, now U.S. Pat. No. 3,917,280 which is a continuation-in-part of Ser. No. 313,352, filed Dec. 8, 1972, now abandoned. The present invention relates generally to putting aid devices and more specifically to a machine and method to aid the average golfer in calculating and verifying the proper distance and direction in which a golfer must stroke a putt if the ball is to go into the cup, taking into account the many variables involved.

DESCRIPTION OF THE PRIOR ART

In the field of putting devices, a major concern has been to provide devices to aid the golfer in aligning the golfer's own putter head with the cup or flag. Others have used mirrors and other optical devices to allow the golfer to align his putter head with an imaginary spot to accommodate for the lie of the green and stroke in that direction to achieve a perfect putt. Other devices have been developed to read the green physically by the use of a pendulum apparatus.

All of the devices of the prior art are based on the assumption that the golf player will stroke the ball accurately every time, and that the golf player will judge both the required distance and direction required for the particular putt accurately each time. These assumptions have no basis since most golfers' actions are not precisely the same on each stroke and neither is there a valid means at the present time to verify his calculations of a proper distance and direction. Thus, the present device avoids the errors inherent in the above assumptions by actually demonstrating, using objective standards, a correct putt. This allows the golfer to verify his decisions as to the distance and lie of the green. Also, by marking the putting plane of a correct putt, the golfer can test his ability to duplicate the verified putt.

The present putting machine and method enables a golfer to calibrate his putting stroke for an adjusted distance to a standardized distance built into the putting machine. By using a machine that will produce a standardized putt for a given distance, the golfer can study the other variables such as the lie and speed of the green. The present inventin enables the player to improve his expertise in reading the greens and judging breaks in the putt caused by such variables as the roll of the terrain, the grain and thickness of the grass, and varying weather conditions. The present invention allows the golfer to test the accuracy of his determination of the condition and lie of the green by projecting the ball across the putting surface with a standard precalculated amount of force. By repeated adjustments of the force until the ball enters the cup, the golfer can learn to correct his decision-making process and estimation of the distance and lie of the green. The golfer may also vary the trajectory of the ball and adjust the amount of force for the preselected trajectory depending on the condition and lie of the green. Pins are provided to mark the plane of the machine's putter, so that the golfer can test his ability to duplicate the machine-verified, adjusted distance using the machine defined putting plane.

SUMMARY OF THE INVENTION

The present invention is a method and machine for teaching the golfer to read the greens correctly by the repetitive process of estimating the distance to the cup and compensating said distance for the condition of the green, applying a precalibrated amount of force based on that distance, and observing the results. By adjusting the calculated distance to the cup, the golfer is able to learn to adjust his original calculation of putting surface conditions. By the use of a built-in optical system, the present putting machine will also allow the ball to be projected across the putting surface at an angle other than the line of sight from the putting machine to the cup or pin. Additionally, pins are provided to mark the putting plane of the machine so that a golfer can test his ability to duplicate the machine's putt using the marked putting plane. The apparatus includes a housing with a transparent viewing plate, a spring loaded putter head assembly carrying an adjustable optical system with centerlines thereon, and a traversing mechanism that enables the golfer to move the putter and optical system relative to the housing until the centerlines thereon are aligned in the proper direction for the putt. A plurality of pairs of apertures or slots are provided in the putter head assembly for marking the putting plane with pins inserted therein. By alignment or misalignment of the optical system's centerline, the golfer can verify his selection of the angle the putter makes with the line of sight to the cup which would produce a trajectory required to place the ball in the cup. Also, an adjustment of the force for the different trajectories is possible. The golfer can test his ability to duplicate the force required, as verified by the machine, by putting the golf ball using the putting plane of the machine as marked by the pins.

OBJECTS OF THE INVENTION

An object of the present invention is the provision of a method for teaching the golfer to properly read the putting surface.

Another object is to provide an apparatus for verifying the golfer's analysis of the green using an objective standard.

A further object of the invention is the provision of a putting machine to verify the golfer's estimation of a proper angle with respect to the line of sight to the cup along which the ball should be stroked.

Still another object of the present invention is to provide a method and means to allow a golfer to read the variables of the putt correctly without the variables in his own stroke being involved.

An even further object of the present invention is to provide an economical and effective means to allow the average golfer to improve his techniques and drastically reduce his score.

A still further object of the present invention is to provide a means of marking a vertified putting plane to enble the golfer to test his ability to duplicate a verified putt.

Other objects, advantages and novel features of the present invention will become apparent from the following detailed description of the invention when considered in conjunction with the accompanying drawings.

BRIEF DESCRIPTION OF THE DRAWINGS

FIG. 3 is a perspective cut-away view of a modification of the preferred embodiment;

FIG. 4 is a view of the indicator of FIGS. 1 and 2.

FIG. 5 is an illustration of the use of the preferred embodiment on a green; and FIG. 6 is the view that the golfer would have in the glass viewer in the embodiment as used in FIG. 5.

DETAILED DESCRIPTION OF PREFERRED EMBODIMENTS

Figure 1:
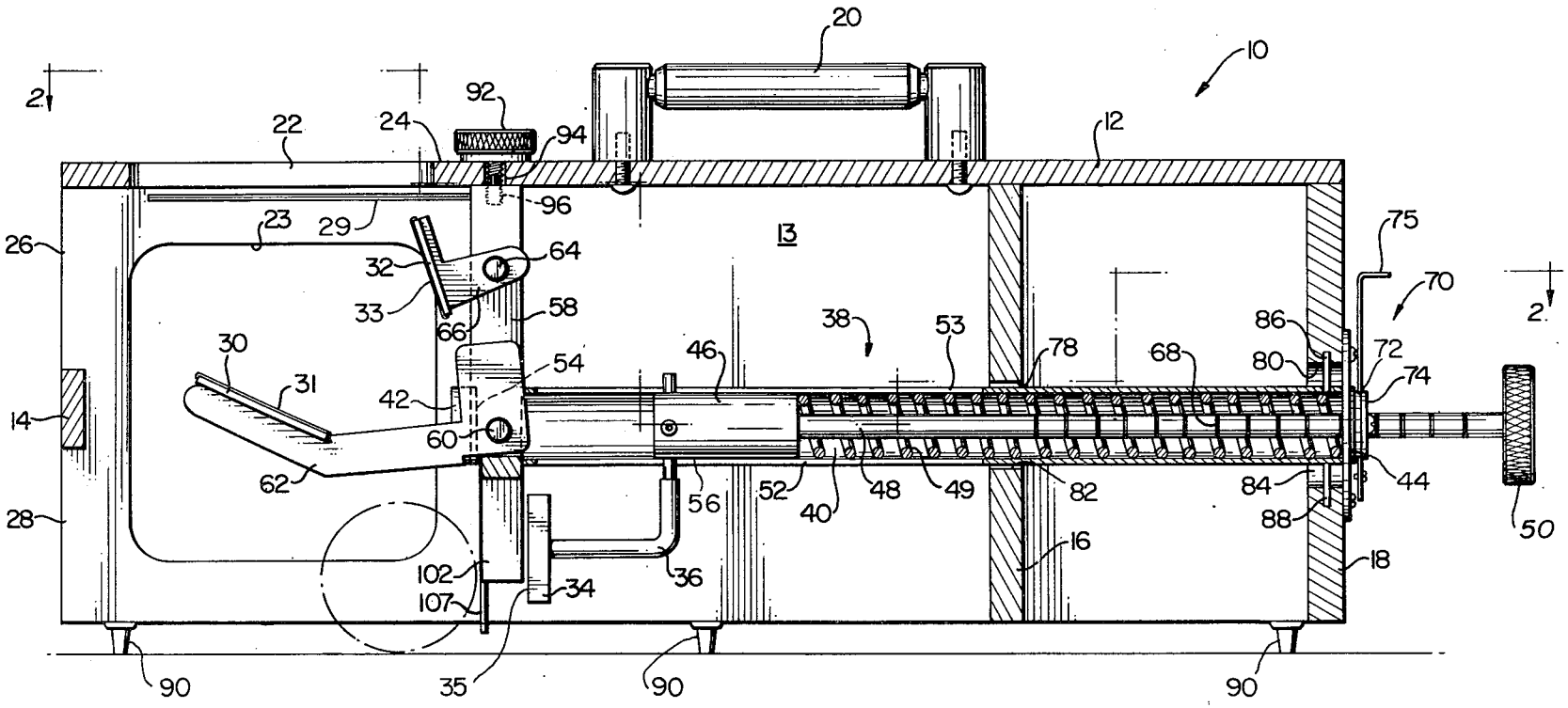
FIG. 1 is a side sectional view of the preferred embodiment.

FIG. 1, which illustrates a side cut-away view of the preferred embodiment, shows the putting machine 10. The putting machine has top wall 12, side walls 13, front wall 14, center wall 16, and rear wall 18 for portably housing the device. A top wall 12 has a handle 20 mounted thereto and an aperture 22 therein which (as will be explained later) is used to align the optical system. Alternatively, apertures 22 may be replaced with a transparent material. In either case, both side walls 13 have an opening 23 to allow adjustment of the optical system, placement of the ball and marking of the putting plane, which will also be explained later.

On the top wall 12 is a center line 24, which may be etched or may be a decal, corresponding to the center line of the housing. The front wall 14 of the housing has two apertures 26 and 28. The first aperture 26 is used in conjunction with the optical system to be explained later and may also be replaced with a transparent material. The aperture opening 28, in the front wall 14, allows the ball projected by the putter head to leave the housing. Extending substantially horizontally from the putter head assembly is a sight rod 29 corresponding to the center of the putter head. Pivotally mounted to the putter head assembly are two adjustable mirrors 30 and 32 which are used in conjunction with housing centerline 24 and sighting rod 29 to align the housing with the cup or flag and later to align the force-inducing spring biased putter with respect to the housing. The mirrors 30 and 32 include centerlines 31 and 33, respectively which, when properly aligned with sight rod 29, prevent parallactic sighting. It should be noted that only two of the three sighting devices (29, 31 and 32) are needed, thus one of the centerlines (31 and 33) may be omitted. Also, the sighting device can function if only one of the mirrors (30, 32) is adjustable.

The putter head assembly includes a putter head 34, having a centerline 35 thereon, which is attached by an arm 36 to the force-inducing mechanism 38. The force-inducing mechanism 38 has a generally light-weight cylindrical metal housing 40 with caps 42 and 44 at its respective ends. Within said housing is a spring biased plunger or piston having a head 46, a shaft 48 and a handle 50. The spring 49 exerts force between the rear cap 44 of the cylinder and the head 46 of the plunger. The arm 36 of the putter head 34 is attached to and extends above the head 46 of the plunger and rides within longitudinal grooves 52 and 53 of the spring housing 40. Mounted on the housing at cap 42 is a shock absorbing elastomeric material 54 which absorbs and stops head 46 of the plunger at the end of its forward motion. On the head 46 of the plunger is a bearing surface 56 of any suitable friction-reducing material, such as teflon, to aid in the movement of the plunger.

Mounted on cylindrical housing 40 is optical assembly support 58 to which sight rod 29 and adjustable mirrors 30 and 32 are mounted. Near the bottom of optical assembly support 58 are two screws 60 which adjustably mount mirror frame support 62 to support 58 and to which is mounted mirror 30. Near the top of optical assembly support 58 are two screws 64 which adjustably mount mirror frame support 66 to support 58 and to which is mounted mirror 30. By adjustment of mirrors 30 and 32, the golfer may view targets at different distances from the machine through the optical system.

The plunger shaft 48 is shown as having a plurality of ratchet surfaces 68 therein. These surfaces coact with a trigger device 70 having a pawl or locking member 72 which engages the ratchet surface 68. Encompassing shaft 48 and pawl 72 is guide 74 which limits the pawl 72 to vertical movement into and out of engagement with ratchet surface 68. Handle 75 is connected to pawl 72 to release the trigger device. A spring may be provided to rest between the handle 50 and the guide 74, and shock absorbing elastomeric material 54, which is mounted to cap 42, may be provided to absorb some of the force of the piston at the end of its forward stroke and thereby prevent damage to guide 74 and front wall 42 of the force-inducing mechanism 38.

The force-inducing mechanism 38 transverses the center wall 16 through an aperture 78 and the rear wall 18 through an aperture 80 and rests on bearing surfaces 82 and 84, respectively. The plunger is pivotally mounted to the rear wall 18 by pins 86 and 88. This allows for adjustment of the force-inducing mechanism 38 within the horizontal plane of the body or housing of the putting machine 10. The housing is detachably secured to the putting surface by golf spikes 90 secured to the bottom of the housing. If a hard putting surface is being used to teach the individual the estimation of distance such as block top or a floor, the spikes 90 may be replaced by adhesive surfaces 114 as shown in FIG. 3.

The angle which the putting head makes with the housing or the line of sight to the cup is adjustable. A locking assembly includes screw 92 which passes through an arcuate slot 94 in top wall 12 and is received within a threaded journal 96 in the top of optical system support 58. Two pegs 98 are mounted on each side of journal 96 in the top of support 58 and aid in the guiding of the putter head assembly when traversing arcuate slot 94. By moving the loosened screw 92 right or left, the force-inducing mechanism 38 is pivoted on pins 86 and 88 to align the putter head to a given angle with respect to the centerline 24 of the housing.

Secured to the bottom of optical system support 58 is a generally U-shaped member 100 having two parallel legs 102 and 104, which define the plane at which the putter head 34 hits the ball. In the forward face of each leg 102 and 104 is a vertical groove 106 in which a pin 107 is inserted to mark the putting plane. A plurality of pairs of apertures 106' are also provided in member 100 to mark planes for a variety of lengths of putter heads. Once the pins are inserted and the machine moved, the golfer can try to duplicate the putt of the machine using the same putting plane as defined by the pins.

Figure 2:
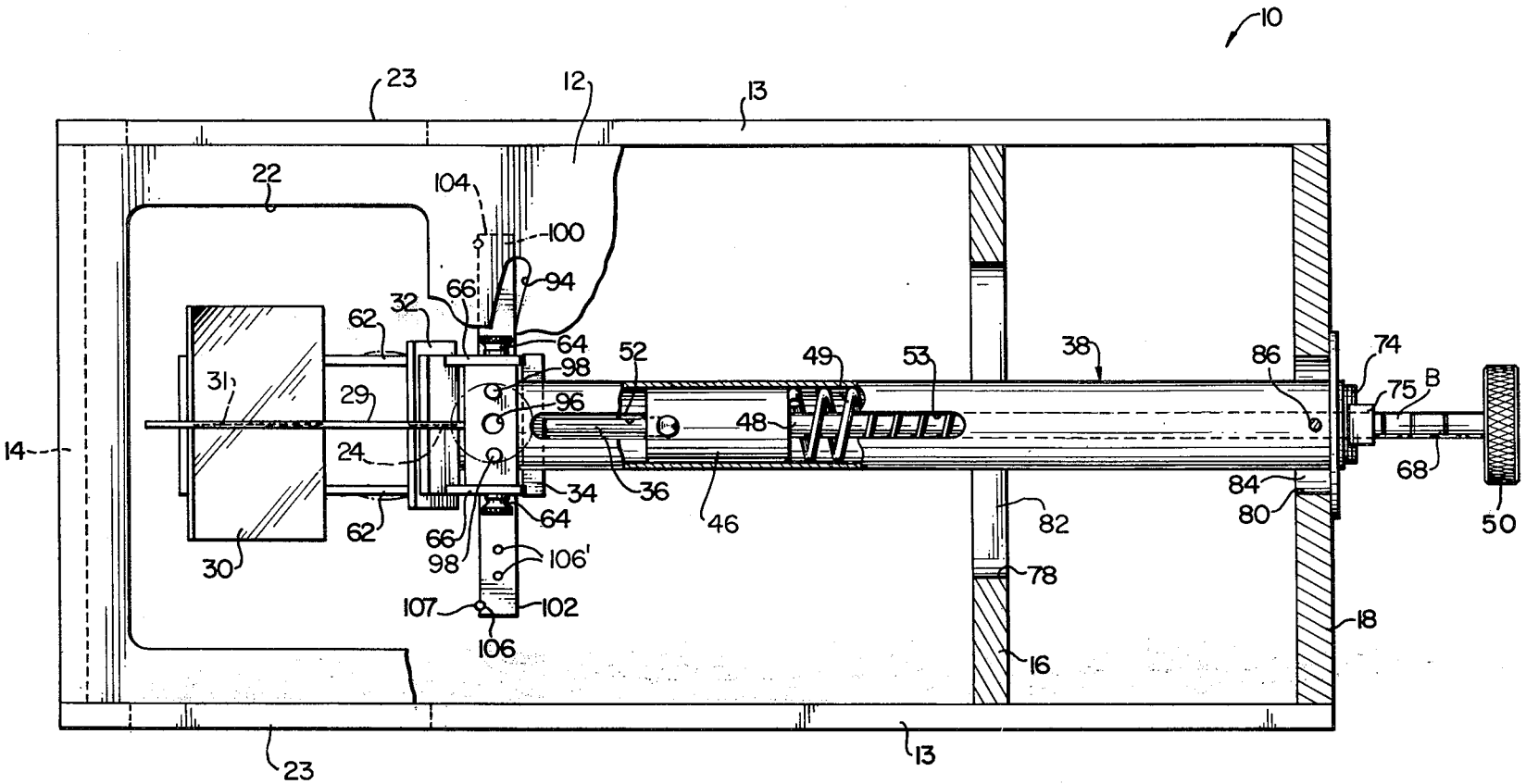
FIG. 2 is a top cut-away view of the preferred embodiment taken along line 2—2 of FIG. 1.

As alluded to earlier, the ratchet surface 68 contains indicia for aiding the golfer in selection of a precalculated force. This indicia, as shown in FIG. 4, starts with a three-foot putt and could run up to as high as is feasible, such as a 25-foot putt. Also shown is a B position, which indicates the distance that the plunger or putter has to drawn back to allow for positioning of the golf ball in the putting machine through aperture 23 in side wall 13. The plunger is illustrated in the B position in FIGS. 1 and 2, which permits the ball to be placed approximately in the position shown in dotted lines.

A modified form of the calibrated force indicating section of the preferred embodiment is shown in FIG. 3. Here an indicator 108 is attached to the movable wall or plunger head 46 and rides within a channel 110 in the cylindrical spring housing 40 and in channel 112 in the side wall 13 of the housing of the putting machine 10. Indicia is shown as being contained on the exterior of the housing. By pulling back the plunger handle 50 until the indicator 108 is opposite the indicia on the housing, which represents the estimated distance to the hole with the compensation for the green conditions and lie, the precalculated force is selected. Also shown in FIG. 3 is the use of adhesive pads 114 instead of the spikes 90.

OPERATION

The putting device is placed upon the green and detachable secured by spikes 90 or adhesive pads 114. Initially, the centerline 24 of the machine should be substantially aligned with the line of sight to the cup to permit as wide a range of movement for the optical system as possible. The mirrors 30 and 32 are adjusted until the cup appears in the optical system. Next, sight rod 29 and centerlines 31 and 33 of mirrors 30 and 32, respectively, are aligned with the cup by moving screw 92 in arcuate slot 94. The putter 34 is thus aligned such that its centerline 35 is coincident with the line of sight to the pin or cup. Of course, it would be possible to initially center the putter 34 by positioning sight rod 29 coincident with housing centerline 24 and then shifting the putting device housing 10 until the cup is located on sight rod 29 and centerlines 31 and 33.

Now that the putter 34 has been aligned, the golfer may verify his estimation of distance to the green. For a green having a flat lie, the golfer estimates the distance to the cup, taking into account the thickness and dampness of the grass and applying a distance compensation therefor. The indicator handle 50 is pulled back until the indicator is opposite the indicia B which indicates the position of the plunger or putter head for placing the ball. The ball is then placed in front of the putter centered on putter centerline 35. The indicator handle is then moved further back until the indicia representing the estimation of the distance to the hole plus a compensating factor for the condition of the green is opposite the rear wall 44 as shown in FIG. 1 or is opposite the indicia as shown on the side of the housing in FIG. 3. After the distance has been selected, the trigger mechanism 70 is then released by pulling handle 75, which releases the ratchet 72 and allows the putter head 34 to stroke the ball perfectly with a precalibrated force which corresponds to the distance marked on the indicia. The positioning of the ball as shown in FIG. 1 allows the putter to stroke the ball and continue moving, thereby stimulating a follow-through and insuring a well-stroked ball. The golfer then can see whether his estimation of the distance with the compensating factor was proper. If the ball did not go into the hole by either falling short of speeding past the hole, the golfer may now compensate his estimate of the distance and try again. This process is repeated until the ball goes into the hole, at whichpoint the golfer may mark the putting plane with the provided pins. The machine is then removed and the golfer tries to make the putt using the machine-defined and pin-marked plane.

In many instances, the green is not a flat lie and compensation in the trajectory must be made for the lie of the green. To illustrate this principle, we refer to FIGS. 5 and 6. In FIG. 5, the general machine is shown at 10, sitting on green 200 having cup 202 and flag 204 therein. The golfer's estimation of the lie of the green requires a putt to be directed towards a small flag 206 or other suitable marker which he has placed on the green. The golfer preferably positions the putting machine 10 so that it has its centerline 24 coinciding with the line of sight 208 between the machine and the pin 204 in the cup 202. Then the golfer adjusts the position or angle that force-inducing mechanism 38 makes with the centerline 24 or line of sight 208. By moving screw 92, in arcuate slot 94 unit, the little flag 206 is made coincident with sight rod 29 and centerlines 31 and 33, thus creating a line of sight 210 for the putter head 34.

A view of what the golfer would see through the optical system is shown in FIG. 6. The flag 204 and cup 202 are shown aligned with the housing centerline 24 and the small flag 206 is shown coincident with the sight rod 29 and centerlines 31 and 33. The golfer would then estimate the distance to the cup 202 by a trajectory aiming at flag 206. By repeating the estimation process, the golfer can learn to adjust his distance for various trajectories produced by aiming at flag 206 which will intersect cup 202. Another approach would be to use the same force and adjust the position of the flag 206 until the proper trajectory is found which would intersect cup 202 using a constant force. Thus, by varying the angle the putter 34 makes with the line of sight and the amount of force, a plurality of trajectories (all of which will put the golf ball into the cup) can be developed which would correctly read the green. As with a line-of-sight putt, once the ball goes into the hole, the golfer marks the putting plane with the provided pins. The machine is then removed and the golfer tries to make the putt using the machine's verified and pin-defined putting plane.

This readily permits the golfer to estimate the distance and trajectory of the various putts and verify these by using a machine which will accurately putt the ball along a given trajectory with a given amount of precalibrated force. By initially removing the variance in the golfer's stroke, the golfer is able to verify his estimation of lie and condition of the green without questioning the quality of his putt. Once he has verified his estimation of the green condition and lie, he tries to duplicate the putt using a verified putting plane. By becoming a proficient putter with the use of this machine, the average golfer can reduce his score significantly.

Although the invention has been described and illustrated in detail, it is to be clearly understood that the same is by way of illustration and example only and it is not to be taken by way of limitation. The spirit and scope of this invention are to be limited only by the terms of the appended claims.

What is claimed:

1. A method for learning to accurately putt a golf ball comprising:

the step of providing a machine which is capable of repeatedly projecting a golf ball from a first area on a putting green to a second area on said putting green for a given disposition of said machine;

the step of estimating the distance between said first and said second areas;

the step of estimating the direction a golf ball should follow to roll on said putting green from said first and to said second area;

the step of setting said machine at said first area in accordance with said estimates of distance and direction;

the step of positioning a golf ball to be projected by said machine from said first area to said second area;

the step of projecting said positioned golf ball by said machine to said second area;

repeating, if necessary, the two steps of estimating, the step of setting said machine and the steps of positioning and projecting said golf ball until said golf ball is projected by said machine into said second area;

the step of marking the putting plane through which said golf ball was projected by said machine into said second area;

the step of placing a golf ball in proximity to said putting plane;

and the step of stroking said golf ball placed in proximity to said putting plane with a putter using said putting plane as a guide.

2. A method according to claim 1 wherein said putting plane is marked perpendicular to the direction of movement of said golf ball projected by said machine at a location in proximity to the point where said golf ball is released by said machine.

3. A method according to claim 2 wherein the step of marking said putting plane includes the placement of two pins into said putting green and thereafter the removal of said machine.

4. A method according to claim 3 wherein said second area on said putting green is a cup.

* * * * *